US011910965B2

(12) United States Patent
Gaton

(10) Patent No.: US 11,910,965 B2
(45) Date of Patent: Feb. 27, 2024

(54) SPINDLE FOR RESTRICTED MOVEMENT OF CONTINUOUS FORMAT PRODUCTS ROLL

(71) Applicant: Errol Gaton, Cambria Heights, NY (US)

(72) Inventor: Errol Gaton, Cambria Heights, NY (US)

( * ) Notice: Subject to any disclaimer, the term of this patent is extended or adjusted under 35 U.S.C. 154(b) by 0 days.

(21) Appl. No.: 17/835,465

(22) Filed: Jun. 8, 2022

(65) Prior Publication Data

US 2023/0248190 A1 Aug. 10, 2023

Related U.S. Application Data

(60) Provisional application No. 63/308,581, filed on Feb. 10, 2022.

(51) Int. Cl.
*A47K 10/38* (2006.01)

(52) U.S. Cl.
CPC ..... *A47K 10/38* (2013.01); *A47K 2010/3863* (2013.01)

(58) Field of Classification Search
CPC ..... A47K 10/38; A47K 10/40; A47K 2010/3863; B65H 75/02; B65H 75/18
USPC ..... 242/599.4
See application file for complete search history.

(56) References Cited

U.S. PATENT DOCUMENTS

| | | | | | |
|---|---|---|---|---|---|
| 432,738 | A * | 7/1890 | Morgan | B65H 23/06 | 242/422.4 |
| 899,461 | A * | 9/1908 | McNeil | B65H 16/06 | 242/422.4 |
| 1,205,245 | A * | 11/1916 | Morgan | A47K 10/38 | 242/565 |
| 1,559,151 | A * | 10/1925 | Brasch | B65H 35/0006 | 242/422.4 |
| 2,889,121 | A * | 6/1959 | Heinle | B65H 75/245 | 242/599.4 |
| 3,061,218 | A * | 10/1962 | Moore | A47K 10/32 | 242/422.5 |
| 3,170,652 | A * | 2/1965 | Kennedy | A47K 10/40 | 242/599.1 |
| 3,281,089 | A * | 10/1966 | Krueger | A47K 10/38 | 242/422.4 |
| 3,770,221 | A * | 11/1973 | Stern | B65H 75/08 | 242/596.7 |
| 4,071,200 | A * | 1/1978 | Stone | A47K 10/40 | 242/599.4 |

(Continued)

*Primary Examiner* — William A. Rivera
(74) *Attorney, Agent, or Firm* — Brennan, Manna & Diamond, LLC

(57) ABSTRACT

The present invention relates to a multipurpose spindle for dispensing a continuous format product, such as toilet paper. The spindle is configured to restrict movement of product or paper off the roll to reduce the length of product removed. More specifically, the spindle includes a hollow arm having a thick arm and a thin arm, a plurality of spring biased paper restrictors, and the restrictor touches the paperboard core of a roll to restrict movement of paper off the roll. A central torsional spring positioned inside the hollow arm also helps in restricting the movement of the paper product. The paper restrictors are depressed to slide the spindle through a paper roll and are released to touch the paperboard core of the roll.

13 Claims, 5 Drawing Sheets

(56) References Cited

U.S. PATENT DOCUMENTS

| | | | | |
|---|---|---|---|---|
| 4,447,015 | A * | 5/1984 | Peterson | A47K 10/40<br>242/612 |
| 7,828,240 | B2 * | 11/2010 | Hagleitner | A47K 10/38<br>242/598.3 |
| 7,850,114 | B2 * | 12/2010 | Lavy | A47K 10/46<br>16/904 |
| 9,398,834 | B2 * | 7/2016 | Benedetti | A47K 10/38 |
| 11,006,787 | B2 * | 5/2021 | Abuharthieh | A47K 10/38 |
| 2006/0217820 | A1 * | 9/2006 | Holt | A47K 10/40<br>700/46 |
| 2010/0084503 | A1 * | 4/2010 | Burgess | A47K 10/40<br>242/565 |
| 2012/0097790 | A1 * | 4/2012 | Wilkins | B65H 75/08<br>206/0.5 |

* cited by examiner

SPINDLE FOR RESTRICTED MOVEMENT OF CONTINUOUS FORMAT PRODUCTS ROLL

CROSS-REFERENCE TO RELATED APPLICATION

The present application claims priority to, and the benefit of, U.S. Provisional Application No. 63/308,581, which was filed on Feb. 10, 2022, and is incorporated herein by reference in its entirety.

FIELD OF THE INVENTION

The present invention relates generally to the field of paper product holders and dispensers. More specifically, the present invention relates to a unique plastic and metal spindle for a roll of bathroom tissue, such as toilet paper, paper towels or other wipes, cloths or consumables that may be provided in a continuous format. Other products, such as tapes and ribbons, may also be provided on a central core and are intended for unwinding from the central core. The spindle is comprised of several springs and plastic attachments and is configured to insert through the product roll to restrict the movement of paper or other material off the continuous product format, such as a roll, by using a plurality of paper restrictors positioned on the spindle. The spindle prevents excess product from being pulled or removed from the roll, and thus minimizing consumption and avoiding unnecessary waste of the product. Accordingly, the present disclosure makes specific reference thereto. Nonetheless, it is to be appreciated that aspects of the present invention are also equally applicable to other like applications, devices and methods of manufacture.

BACKGROUND

By way of background, bathroom tissue, such as a toilet paper, is usually a long strip of paper having regularly occurring perforations to create individual sheets (called toilet paper, toilet tissue, bathroom tissue) and are wrapped around a paperboard or other core or may be wound on itself for storage in a dispenser near a toilet. Toilet paper is primarily used for cleaning the anus and surrounding region. Other uses of toilet paper include facial tissues, make up removal, etc. Toilet paper rolls are generally stored on spindles and holders where a user dispenses from the roll by pulling the free end of the paper. However, a problem with conventional spindles and holders is that people unknowingly pull too much paper, as the spindles do not provide any restriction to pulling off excess paper from the roll. In addition, children and pets are known to unwind rolls of paper and can create an unwanted mess on or near the mounted roll.

In fact, the biggest problem with conventional spindles and holders is that of incredible waste. Toilet paper itself is bad for the environment. Therefore, excess use of toilet paper is harmful for the environment and can clog septic and municipal systems. People end up unrolling excessive paper which is also costly, in addition to being harmful for the environment.

Studies show that on average, every American uses three rolls of toilet paper each week and approximately 27,000 trees are cut down every day just to make toilet paper. A novel spindle is required that can reduce the use and waste of toilet paper and helps in reducing the environmental impact and, in addition, saves money for people.

Therefore, there exists a long-felt need in the art for a spindle for toilet paper rolls and other continuous format products that can prevent excess toilet paper and other products from being pulled from the roll. There is also a long-felt need in the art for a spindle that restricts the movement of paper being pulled off a paper roll or other continuous format. Additionally, there is a long-felt need in the art for a continuous format roll spindle that helps in reducing toilet paper usage. Moreover, there is a long-felt need in the art for a spindle that is aids in meeting sustainability goals, is environmentally beneficial and allows users to save money. Further, there is a long-felt need in the art for a modified spindle that can be used for storing toilet paper, paper towels, and other continuous format products, e.g., tapes, ribbons, cloth, etc. Finally, there is a long-felt need in the art for a continuous format spindle that can be used with any holder, any paper or other continuous product roll, and offers a way for consumers to save money while still being environmentally sensitive.

The subject matter disclosed and claimed herein, in one embodiment thereof, comprises a spindle for dispensing a continuous format of paper or other product. The spindle includes an elongated hollow arm that has a first connector and a second connector. The connectors are used for securing the spindle to a roll holder chamber. The hollow arm has a thick arm and a thin arm. The diameter of the thick arm is larger than the diameter of the thin arm. The thick arm has a pair of paper restrictors, and the thin arm has a pair of paper restrictors. The roll restrictors are coupled to individual springs and are configured to depress and when depressed enable the user to insert the spindle through the roll and the restrictors are released when the spindle is in place to hold the roll. The roll restrictors restrict the movement of the roll for dispensing a limited length of the material from the roll to avoid waste.

In this manner, the continuous format product roll spindle of the present invention accomplishes all of the foregoing objectives and provides users with a modified spindle for holding toilet paper, paper towels, and other continuous format rolls of products. The spindle features springs that restrict movement of the continuous format from being pulled to prevent excess product from being removed or pulled from the roll and therefore, saves money for consumers while still being environmentally conscious.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a spindle for dispensing a limited length of a continuous format roll product. The spindle further includes a longitudinal cylindrical arm that has a thick cylindrical portion and a thin cylindrical portion. A pair of oppositely positioned restrictor protrusions extend vertically from the thick cylindrical portion, and a pair of oppositely positioned restrictor protrusions extend vertically from the thin cylindrical portion. Each restrictor protrusion is connected to a spring, such that the spring is configured to depress when the restrictor protrusion is depressed. A pair of connectors are positioned at the opposite ends of the longitudinal cylindrical arm for securing the spindle to a continuous format roll holder chamber such that the spindle is configured to insert through a continuous format roll product such that the restrictor protrusions touch the continuous format roll product to restrict the movement of the product off the roll when the product such as paper is pulled by a user.

In yet another embodiment, the spindle is made of plastic or lightweight metal, such as aluminum.

In yet another embodiment, the spindle comes in different colors and sizes.

In yet another embodiment, the spindle is removably attached to the continuous format roll holder chamber using the connectors.

In yet another embodiment, a spindle for dispensing a roll of continuous format product is disclosed. The spindle comprising an elongated hollow arm having a first connector and a second connector. The hollow arm has a thick arm and a thin arm, wherein the diameter of the thick arm is larger than the diameter of the thin arm. Each of the thick and thin arms comprise a pair of product restrictors, and the product restrictors are coupled to individual springs and are configured to be depressed. The restrictors are depressed to insert the spindle through the roll and released when the spindle is in place to hold the roll. The paper restrictors restrict the movement of the roll for dispensing a limited length of roll to avoid waste.

In yet another embodiment, a method of dispensing a restricted length of continuous format of a paper or continuous format roll is described. The method includes the steps of providing a spindle to hold the continuous format roll product. The spindle includes a plurality of roll restrictor protrusions, and then depressing the plurality of protrusions for inserting the spindle through the continuous format roll. Next, releasing the plurality of protrusions once the spindle is inserted and set in place to hold the continuous format roll product. The spindle is secured to a roll format holder chamber. Then, dispending product from the continuous format roll product by pulling the free end of the paper or roll product. Restricting free rotational movement of the continuous format roll product off the roll by the protrusions and, as a result, dispensing only a limited length of material from the roll and thus minimizing waste.

In yet another embodiment, a plastic or metal spindle for a roll of continuous format roll product such as paper or paper towels is disclosed. The spindle is configured to hold and dispense a continuous format roll product without waste. The spindle includes a torsional spring along the length of the spindle, and a plurality of paper restrictors are positioned on the exterior surface of the spindle. Each restrictor is in the form of a spring coupled button configured to be pressed by a user. The restrictors are depressed to insert and set in place the spindle to hold a continuous format roll product. The restrictors touch the continuous format roll product of the roll to restrict the movement of the material off the roll to dispense a small length of the material off the roll and thus minimizing waste.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
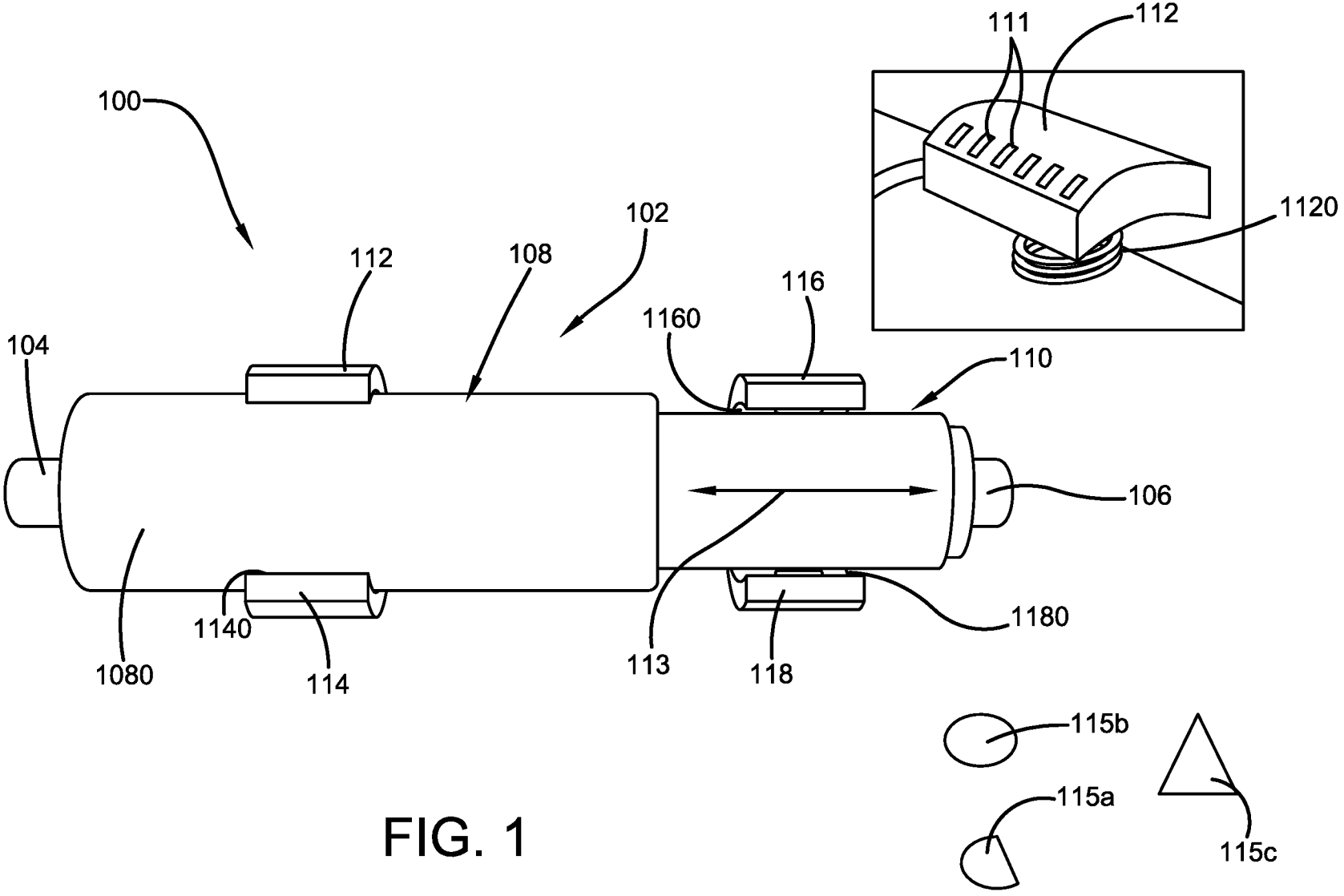
FIG. 1 illustrates a perspective view of one potential embodiment of a continuous product format roll spindle of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a spindle for a continuous format product roll that can prevent excess use of product, such as paper from being pulled from the roll. Continuous format products as used herein, represent a continuous length of material that is wound into a roll or wound on a central core, as opposed to individual sheets that are stacked, fan folded or z-folded into a container. There is also a long-felt need in the art for a spindle that restricts movement of product, such as paper, from being pulled off a roll. Additionally, there is a long-felt need in the art for a continuous product roll spindle that helps in reducing waste of the paper product. Moreover, there is a long-felt need in the art for a spindle that is environmentally conscious and allows users to save money by avoiding over dispensing of product. Further, there is a long-felt need in the art for a modified spindle that can be used for holding continuous format product such as toilet paper, paper towels, cloths, ribbons, tape and other rolls of continuous format products. Finally, there is a long-felt need in the art for a continuous format product spindle that can be used with any holder and any roll and offers a way for consumers to save money while still being environmentally conscious.

The present invention, in one exemplary embodiment, is a novel spindle for dispensing a limited length of a continuous format product roll. The spindle comprising a longitudinal hollow cylindrical arm having a first element, which is a thick cylindrical portion, and a second element, which is a thin cylindrical portion, with a portion of the thin cylindrical portion being inserted into the thick cylindrical portion. A pair of oppositely positioned roll restrictor protrusions extending vertically upward from the first or thick cylindrical portion, and a pair of oppositely positioned roll restrictor protrusions extending vertically upward from the second or thin cylindrical portion. Each restrictor protrusion is connected to a spring such that the spring is configured to depress when the restrictor protrusion is depressed. One or more of the protrusions may be provided with fingers or rubberized bumps to further grip the roll and restrict movement of the roll. A pair of connectors are positioned at the opposite ends of the longitudinal cylindrical arm for securing the spindle to a continuous product roll holder chamber. The spindle is configured to insert through a continuous product format roll, such that the restrictor protrusions touch the roll or core interior to restrict the movement of the product off the roll when product is pulled by a user.

Figure 4:
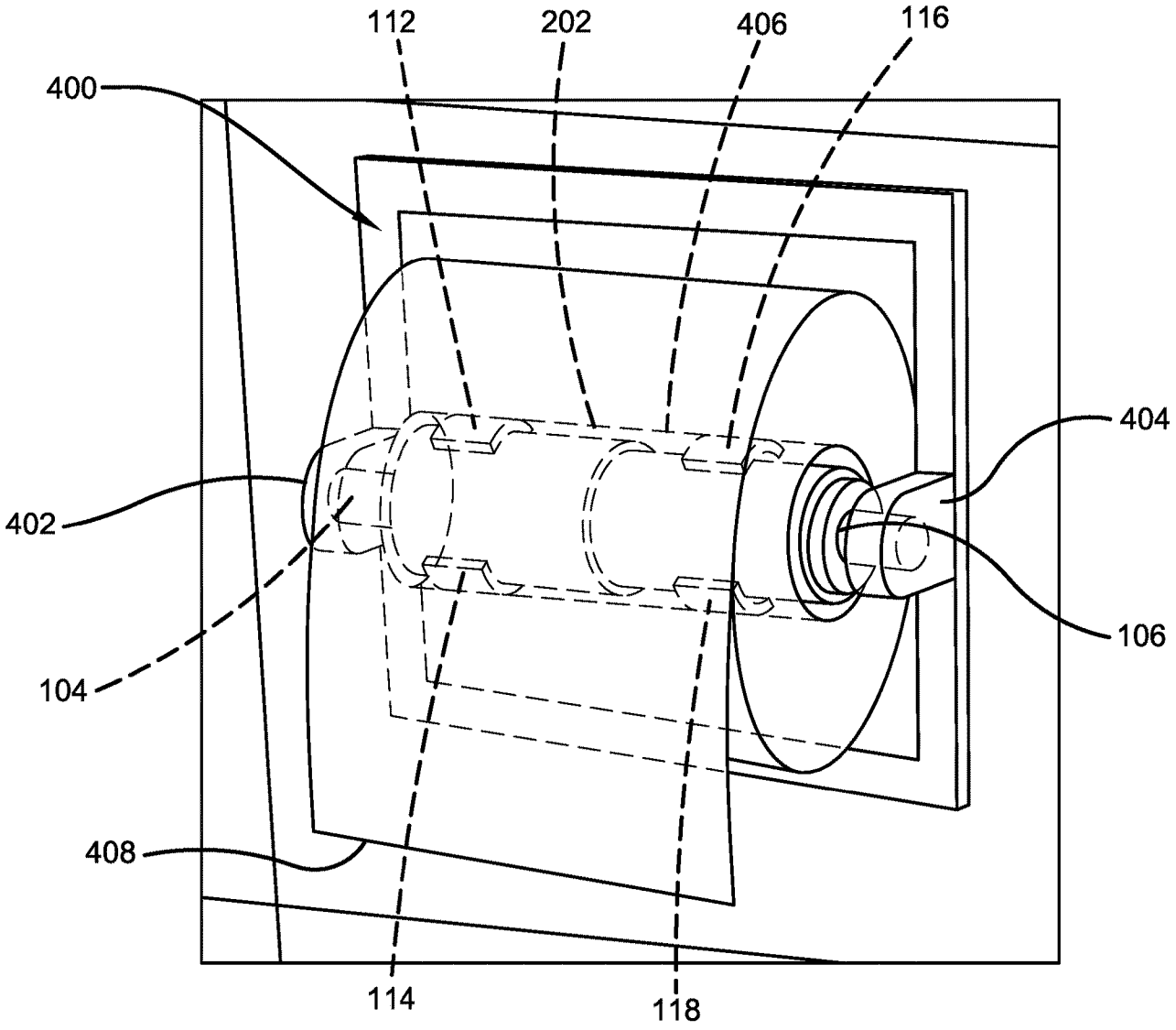
FIG. 4 illustrates a perspective view of the continuous paper product format roll being supported on the plastic or metal spindle of the present invention for dispensing a limited length of the product in accordance with the disclosed architecture.

Referring initially to the drawings, FIG. 1 illustrates a perspective view of one potential embodiment of a continuous product roll format spindle of the present invention in accordance with the disclosed specification. The continuous product format roll spindle 100 of the present invention is designed as a unique spindle adapted to hold and dispense a continuous product format roll. The spindle 100 has a longitudinal horizontal arm 102, having a pair of connectors 104, 106 at opposite ends of the arm. Each of the connectors is configured to fit within receptacles of a support and may be round, square, elliptical or any other shape to meet the bracket of the support of the roll holder. The invention may be provided with different connectors 115*a, b, c* which can be inserted over the ends of the connector so that the continuous roll product format spindle can be used with different brackets without having to purchase a new spindle for each bracket. The connectors 104, 106 are used for securing the spindle 100 to a support bracket or holder body and allowing rotation of the spindle 100 as shown in FIG. 4.

The longitudinal horizontal arm 102 has a first element, which is a thick longitudinal portion 108, and a second element, which is a thin longitudinal portion 110. The second element is movable within the first element 113 in a horizontal direction and is spring loaded to facilitate the reciprocal movement of the elements with respect to one another. The first or thick longitudinal portion 108 has a pair of opposite restrictor protrusions 112, 114 positioned on the exterior surface 1080 of the thick longitudinal portion 108. The restrictor protrusions 112, 114 are used for supporting a product roll on the spindle 100. The second element or the thin longitudinal portion 110 has a smaller diameter than that of the first element or the thick longitudinal portion 108 and has a pair of oppositely positioned restrictor protrusions 116, 118 on the exterior surface 1100. One or more of the restrictor portions 116, 118 may have fingers or extensions 111 extending up from the surface of the restrictors to facilitate gripping the core or roll. In addition, the fingers or extension 111 may be used to aid in gripping different sized rolls. The extensions or fingers may be made from rubber, silicon or other material which can serve to grab and hold the roll. The extensions or fingers 111 may extend up from the restrictors between one and five mm.

Figure 3:
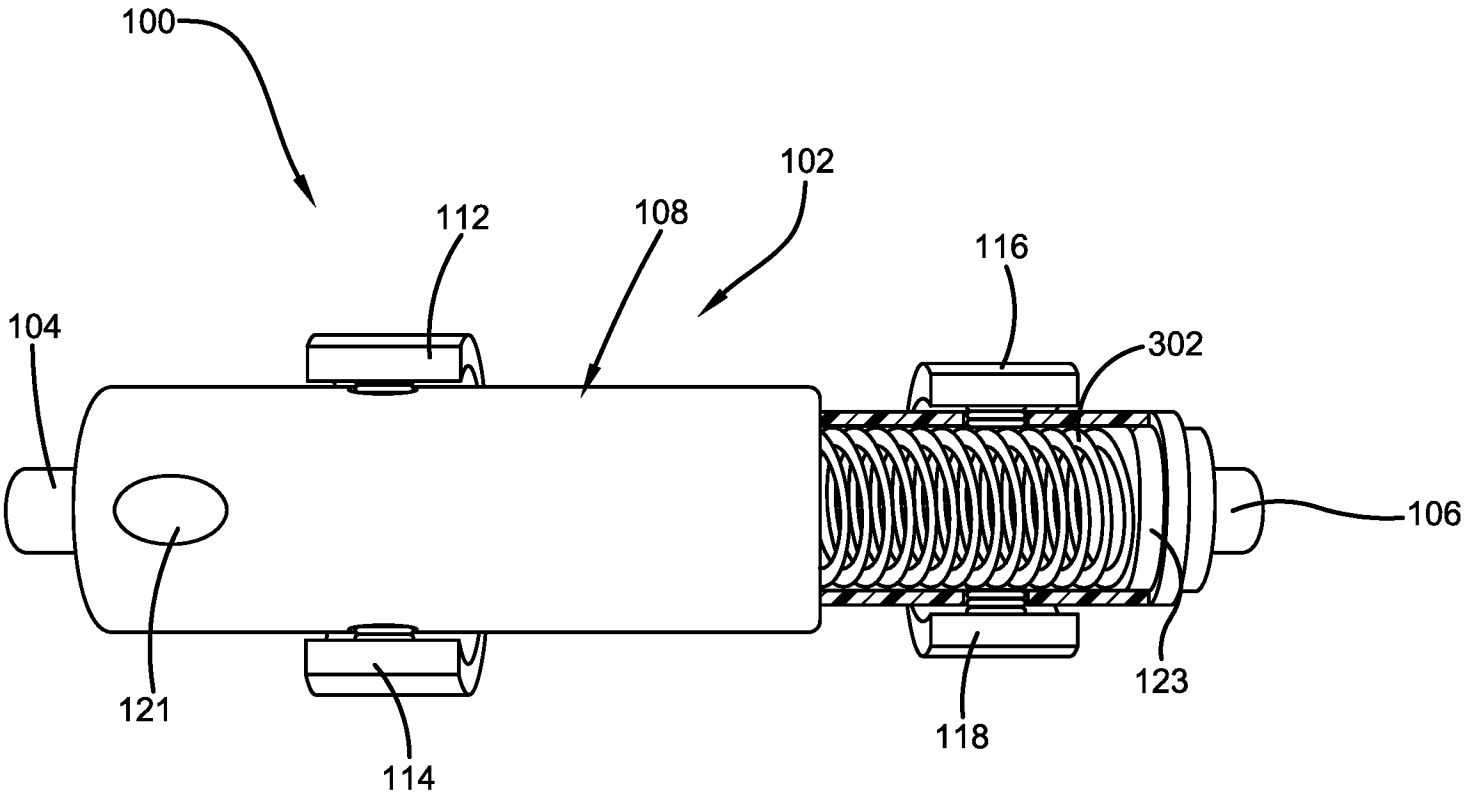
FIG. 3 illustrates a cross-section view of one potential embodiment of the continuous format product roll spindle of the present invention showing the central torsional spring in accordance with the disclosed architecture.

The spindle 100 has a continuous torsional spring positioned along the length and inside the horizontal arm 102 as shown in FIG. 3, for restricting rotational movement of the spindle 100 and preventing excess continuous format product, such as paper, from being pulled from a roll.

The restrictor protrusions 112, 114 and 116, 118 are adapted to be pressed such as by using a finger. Each protrusion is connected to the longitudinal arm 102 using an individual spring that allows the protrusion to depress enabling the spindle 100 to hold a roll of material, such as toilet paper or paper towel roll. The protrusion 112 is coupled to springs 1120, the protrusion 114 is coupled to spring 1140, the protrusion 116 is coupled to spring 1160, and the protrusion 118 is coupled to spring 1180.

The spindle 100 can be made from plastic or metal and can be available in a variety of colors. The longitudinal arm 102 can have a length of about 5-10 cm to fit to a toilet paper holder tray of various sizes. The spindle 100, if made from plastic, may be made from Acrylonitrile Butadiene Styrene (ABS), polyethylene terephthalate (PET), polypropylene and other suitable plastic materials. Metal spindles may be made from aluminum, brass, stainless steel or other suitable materials. The spindle may also be coated or treated with an anti-microbial agent to reduce the growth of bacteria, viruses or other contagions on the spindle.

Figure 2:
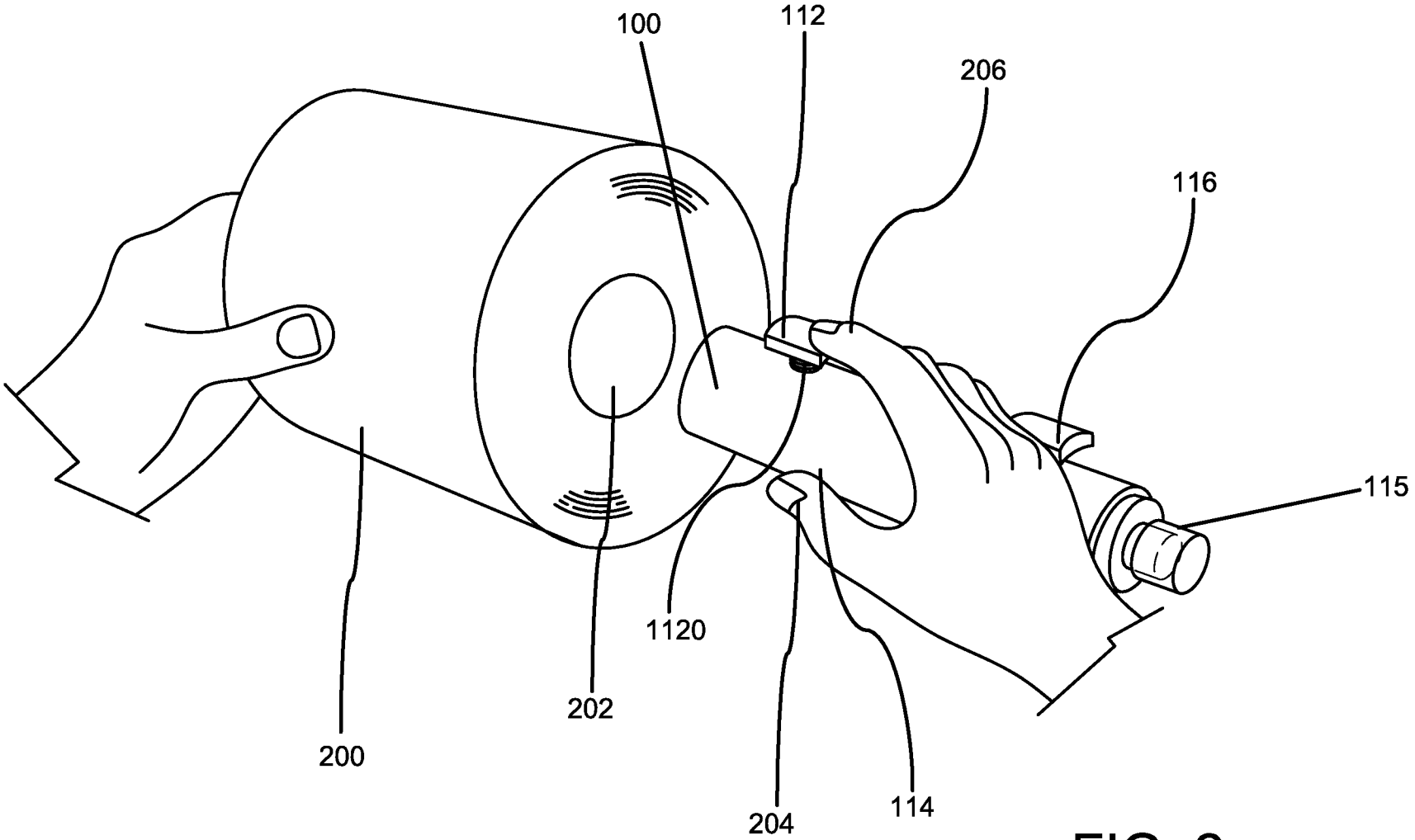
FIG. 2 illustrates a perspective view of a user depressing the protrusions for inserting the continuous product format roll spindle of the present invention through a continuous format product roll in accordance with the disclosed architecture.

FIG. 2 illustrates a perspective view of a user depressing the protrusions for inserting the spindle 100 through a continuous format product roll in accordance with the disclosed specification. The figure shows the combination of a continuous format product 200 being placed on the spindle 100. One of the important features of the spindle 100 of the present invention is the presence of restrictor protrusions on the surface of the spindle 100. As illustrated, as an example, a user depresses the protrusion 112 using a finger 206 that compresses the associated spring 1120 to insert a portion of the thick portion 108 into the paperboard core 202 of the paper roll 200. Similarly, the opposite protrusion 114 is depressed using the thumb 204 or any other finger. The protrusions 112, 114, when depressed, allow the thick portion 108 to insert into the paper roll 200. Similarly, the protrusions 116, 118 are depressed to insert the thin portion 110 through the paper roll 100, thereby enabling the spindle 100 to hold the paper roll 200. The end of the spindle 100 has a bracket adaptor 117 which is placed over the end of the spindle to accommodate the bracket holder or support.

It should be noted that the protrusions 112, 114, 116, 118 are depressed while inserting the spindle 100 through the continuous product format, such as a paper roll 200, and when a protrusion is inside the roll 200, the protrusion is released and abuts against the interior of the roll 200 or paperboard core surface to support and hold the core or roll 200. The size of the spindle 100 is such that the connectors 104, 106 extend from the opposite ends of the paper roll 200 to secure to a holder platform or bracket support.

FIG. 3 illustrates a cross-section view of the paper roll spindle 100 of the present invention showing the central torsional spring in accordance with the disclosed specification. The spindle 100 has a central torsional spring 302 running along the length of the spindle 100 between the connectors 104, 106. The torsional spring 302 is configured to provide rotation to the spindle 100 and the supported product roll to dispense a restricted length of the product, such as a paper from the roll. The spring 302 also restricts the movement of the spindle during rolling of a product, such as a paper roll, when a free end of the product roll is pulled by a user.

Also, the protrusions 112, 114, 116, 118 abutted against the interior of the roll held by the spindle 100 create a friction to free rolling of product, such as a paper, and thus prevent excess product from being pulled from the roll and thus minimizing waste. In the preferred embodiment, the torsional spring 302 is configured to rotate for two complete rotations along the longitudinal axis of the spindle 100 to limit the length of the paper dispensed and unrolled. Further, the spring 302 is automatically rolled to its original position when the product paper from a supported paper roll is not pulled by a user. The spring 302 can be set to rotate for a different number of rotations depending on the type of product on the roll. The spindle can be set to roll or unroll a predetermined amount based on the product roll type. For example, if an adhesive tape is being dispensed and the application is for packaging, then the spring 302 amount can be set to advance between three and 10 rotations depending on the size of the packaging. A sensor 121 can be used to determine the number rotations for the spring 302 and used with a servo motor 123.

FIG. 4 illustrates a perspective view of the continuous format product roll 200 being supported on the plastic or metal spindle 100 of the present invention for dispensing a limited length of the product, such as paper, in accordance with the disclosed specification. The spindle 100 can be used with any concealed spindle holder or wall mounted spindle holder or support bracket, enabling users to use the spindle 100 with any existing continuous format product holder system. As illustrated, as an example, the concealed holder system 400 has two connector receiving slots 402, 404 for receiving and accommodating the connectors 104, 106 to secure the spindle 100. The connector receiving slots may be any suitable shape and the spindle ends may be provided with shaped adaptors to allow the spindle to be put in the bracket slots. The spindle 100 is inserted through the paper roll 200 as described in FIG. 2 for holding the continuous product format roll 200.

The protrusions 112, 114, 116, 118 abut against the interior surface 406 of the core 202 such that protrusions 112, 114, 116, 118, along with any fingers 111, provide restriction and friction to free flowing and loose movement of the product roll 200 as performed by conventional spindle and continuous product holders. The free end 408 of the product paper is pulled by a user allowing the spindle 100 to rotate in a restricted manner for dispensing only a limited length of the paper from the roll.

Figure 5:
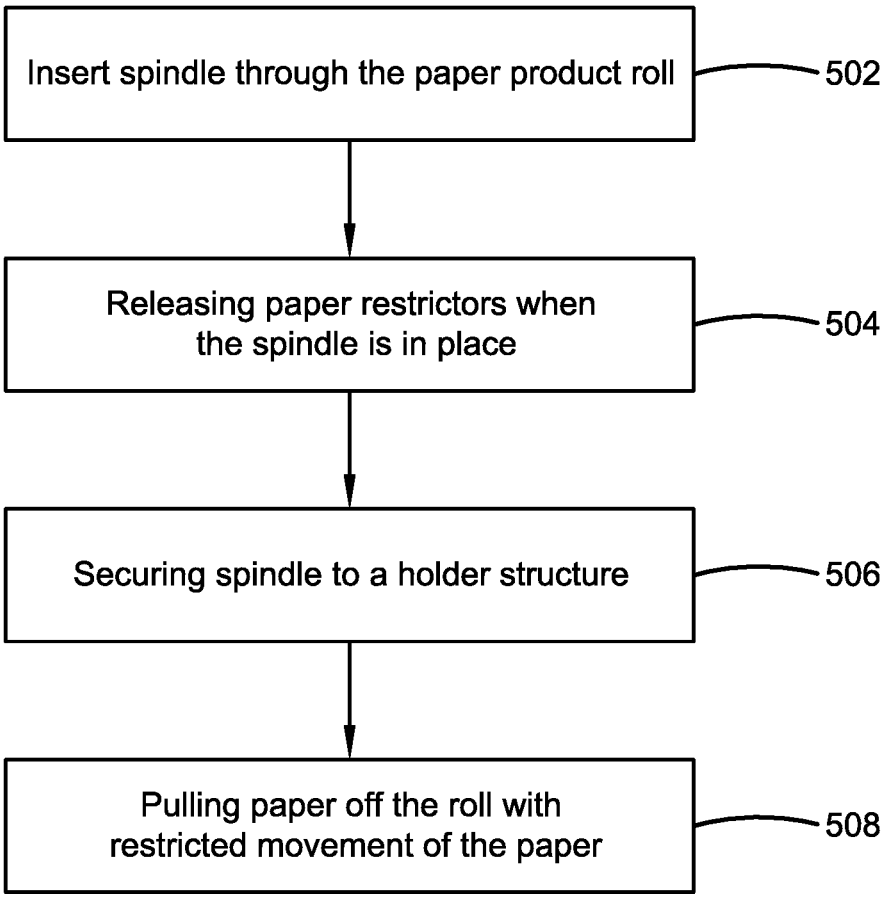
FIG. 5 illustrates a flow diagram illustrating steps performed in using the continuous paper product format roll spindle of the present invention in accordance with the disclosed architecture.

FIG. 5 illustrates a flow diagram illustrating steps performed in using the continuous format product roll spindle of the present invention in accordance with the disclosed specification. Initially, a user presses the paper restrictors to insert the spindle through the continuous format or paper product roll (Step 502). Then, the paper restrictors are released when the spindle is set in place to support the continuous product or paper roll, such that roll restrictors touch the paperboard core of the roll (Step 504). Then, the spindle is equipped with the continuous product format roll is secured to a continuous product paper holder chamber or structure (Step 506). Finally, the continuous format product or paper roll is dispensed by pulling product or paper off the roll, such that the paper restrictors, along with the central torsional spring, restrict movement of the product, such as paper, off the roll (Step 508).

The continuous format product spindle of various embodiments of the present invention allows users pull only a small and adequate length of the product or paper off the roll for reducing product or paper product waste. The spindle apparatus provides a low-cost and multipurpose device for various paper or other product rolls. The apparatus can be used for wall mounted and concealed holders.

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "product spindle", "toilet paper spindle", "roll spindle", "spindle", and "plastic or metal spindle" are interchangeable and refer to the restricted paper product dispensing spindle 100 of the present invention.

Notwithstanding the foregoing, the restricted paper product dispensing spindle 100 of the present invention can be of any suitable size and configuration as is known in the art without affecting the overall concept of the invention, provided that it accomplishes the above-stated objectives. One of ordinary skill in the art will appreciate that the restricted paper product dispensing spindle 100 as shown in the FIGS. are for illustrative purposes only, and that many other sizes and shapes of the restricted paper product dispensing spindle 100 are well within the scope of the present disclosure. Although the dimensions of the restricted paper product dispensing spindle 100 are important design parameters for user convenience, the restricted paper product dispensing spindle 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A continuous format product spindle comprising:

a first element;

a second element, wherein the first element has a larger diameter than the second element and the second element is slidable within the first element by a spring, the first and second element forming a spindle;

a first connector provided on one end of the first element and a second connector provided on an end of the second element, wherein the first and second connectors hold the spindle in a support bracket; and a protrusion on each of the first and second elements; and wherein one or more of the protrusions comprise a plurality of fingers or extensions extending upwardly from the protrusions.

2. The continuous format product spindle as recited in claim 1, wherein each of the first and second element has a pair of protrusions.

3. The continuous format product spindle as recited in claim 1, wherein the protrusions are spring biased.

4. The continuous format product spindle as recited in claim 1, wherein the plurality of fingers or extensions are comprised from one of a rubber or a silicone.

5. The continuous format product spindle as recited in claim 1, wherein the spindle is comprised of a metal or a plastic.

6. The continuous format product spindle as recited in claim 5, wherein the plastic is a select one of an Acrylonitrile Butadiene Styrene (ABS), a polyethylene terephthalate (PET) or a polypropylene.

7. The continuous format product spindle as recited in claim 5, wherein the metal is a select one of an aluminum, a brass or a stainless steel.

8. The continuous format product spindle as recited in claim 1, wherein the spindle is provided with an antimicrobial agent.

9. The continuous format product spindle as recited in claim 1, wherein the spindle comprises a connector adaptor to be placed over each of the connectors.

10. A combination continuous format product and continuous format product spindle comprising:

a continuous format product having a core and a supply of product wrapped around the core;

a continuous format product spindle comprised of first and second elements with the second element having a smaller diameter than the first element, and wherein the second element slidable within the first element;

a spring disposed within the first and second elements; and at least one protrusion provided on each of the first and second elements; and wherein each of the first and second elements is comprised of a pair of protrusions; and wherein at least one of the pair of protrusions comprises a plurality of fingers or extensions.

11. The combination continuous format product and continuous format product spindle as recited in claim 10, wherein each of the pair of protrusions is spring loaded.

12. The combination continuous format product and continuous format product spindle as recited in claim 10, wherein the spindle is comprised of a connector on each end of the spindle.

13. A paper roll spindle comprising:

a spindle comprised of a thicker portion and a thinner portion, wherein the thinner portion has a diameter that is less than a diameter of the thicker portion;

a spring disposed within the thicker and thinner portions;

a connector located on each end of the spindle; and a pair of spring-loaded protrusions provided on each of the thicker and thinner portions; and wherein each of the thinner and thicker portions comprise at least one protrusion comprising a plurality of upwardly extending fingers.

* * * * *